US005329779A

United States Patent [19]

Lozano D. et al.

[11] Patent Number: 5,329,779

[45] Date of Patent: Jul. 19, 1994

[54] METHOD AND APPARATUR FOR COOLING WORKPIECES

[75] Inventors: Luis F. Lozano D.; Ana G. Briceno F., both of Puerto Ordaz, Venezuela

[73] Assignee: C.V.G. Siderurgica Del Orinoco, C.A., Matanzas, Venezuela

[21] Appl. No.: 15,470

[22] Filed: Feb. 9, 1993

[51] Int. Cl.[5] ..... F25D 13/06

[52] U.S. Cl. ..... 62/63; 62/64; 62/374

[58] Field of Search ..... 62/63, 64, 374

[56] References Cited

U.S. PATENT DOCUMENTS

| | | | |
|---|---|---|---|
| 3,589,429 | 6/1971 | Schoffmann . | |
| 3,722,077 | 3/1973 | Armstrong | 62/374 |
| 3,897,906 | 8/1975 | Bachner . | |
| 3,983,925 | 10/1976 | Dutzler . | |
| 4,000,625 | 1/1977 | Beerens et al. | 62/63 |
| 4,040,269 | 8/1977 | Nordblad | 62/374 |
| 4,212,171 | 7/1980 | Soecknick | 62/63 |
| 4,226,092 | 10/1980 | Luthi | 62/63 |
| 4,654,107 | 3/1987 | Ritter | 62/63 |

*Primary Examiner*—Ronald C. Capossela
*Attorney, Agent, or Firm*—Bachman & LaPointe

[57] ABSTRACT

An apparatus for cooling a workpiece, especially a continuous rolled non-flat workpiece includes a cooling passage having an inlet for receiving the workpiece and an outlet for discharging the workpiece, the cooling passage having a central axis and further including an inlet for introducing a cooling medium to the cooling passage, and an outlet for removing the cooling medium from the cooling passage, the cooling medium inlet being arranged relative to the central axis of the cooling passage so as to induce a substantially helical flow of cooling medium around the central axis from the cooling medium inlet to the cooling medium outlet, the cooling medium outlet including a chamber having an expanded flow area, whereby pressure and velocity of the cooling medium in the cooling passage are controlled so as to provide accelerated cooling of the workpiece. Further according to the invention, the cooling medium inlet includes a first cooling medium inlet and a second cooling medium inlet, the chamber being disposed between two segments of the cooling passage between the first and second cooling medium inlet, the first cooling medium inlet being arranged so as to induce a first substantially helical flow of cooling medium around the central axis toward the chamber, and the second cooling medium inlet being arranged so as to induce a second substantially helical flow of cooling medium around the central axis toward the chamber.

25 Claims, 1 Drawing Sheet

METHOD AND APPARATUR FOR COOLING WORKPIECES

BACKGROUND OF THE INVENTION

The invention relates to the field of steelmaking and, particularly, to a method and apparatus for in line cooling of a workpiece, especially a continuous rolled non-flat workpiece.

Steelmaking requires cooling systems for the proper treatment of articles being fabricated. Proper cooling can improve the characteristics of the end product, especially the strength and ductility of the product.

Conventional cooling systems utilize spray systems to spray cooling medium such as water over the surface of fabricated articles. Typical examples of such spray-cooling systems are included in U.S. Pat. No. 3,983,925 to Dutzler, U.S. Pat. No. 3,897,906 to Bachner and U.S. Pat. No. 3,589,429 to Schoffmann.

Spray cooling systems, however, require large volumes of water. Further, the cooling rate achieved by such spray cooling systems is not suitable for "in-line" use. That is, when the article is to be cooled while being conveyed from one treatment station to another, too much space is required to obtain the proper amount of cooling with a spray cooling system. Steel rolling mills, however, typically produce rolled articles at relatively high rolling speeds. Thus, conventional spray cooling is particularly unsatisfactory for use in rolling mills.

It is desirable, accordingly, to provide a cooling system which does not use excessive amounts of water and which provides the desired amount of cooling without requiring excessive amounts of space.

It is therefore the principal object of the present invention to provide a method and apparatus for cooling workpieces which provides accelerated cooling.

It is another object of the present invention to provide such a method and apparatus which does not require excessive amounts of water.

It is still another object of the present invention to provide such a method and apparatus which allows control of the velocity and pressure of the cooling medium.

It is a further object of the present invention to provide such a method and apparatus which are well suited to "in-line" use in a rolling mill.

Other objects and advantages will appear hereinbelow.

SUMMARY OF THE INVENTION

The foregoing objects and advantages are readily obtained by the disclosed invention.

According to the invention, accelerated cooling of a workpiece, especially non-flat rolled steel articles, is accomplished by providing a helical flow of a cooling medium around the workpiece. Such a helical flow provides an accelerated cooling of the workpiece. Furthermore, the cooling medium is readily recirculated so as to markedly reduce the required volume of cooling medium.

According to the invention, an apparatus for cooling a workpiece comprises a cooling passage having inlet means for receiving the workpiece and outlet means for discharging the workpiece, the cooling passage having a central axis and further including inlet means for introducing a cooling medium to the cooling passage, and outlet means for removing the cooling medium from the cooling passage, the cooling medium inlet means being arranged relative to the central axis of the cooling passage so as to induce a substantially helical flow of cooling medium around the central axis from the cooling medium inlet means to the cooling medium outlet means, the cooling medium outlet means including chamber means having an expanded flow area, whereby pressure and velocity of the cooling medium in the cooling passage are controlled so as to provide accelerated cooling of the workpiece.

The method, according to the invention, includes the steps of providing the workpiece, and circulating a substantially helical flow of a cooling medium around the workpiece, whereby the workpiece is cooled.

BRIEF DESCRIPTION OF THE DRAWINGS

A detailed description of the preferred embodiments of the invention follows, with reference to the attached drawings, in which.

DESCRIPTION OF THE PREFERRED EMBODIMENTS

The invention relates to a method and apparatus for providing accelerated and controlled cooling of a workpiece, especially continuously rolled non-flat steel workpieces such as, for example, bars, wire rods, beams, sections and pipes. While the invention is specifically directed to cooling, as will become apparent, the teachings of the invention could suitably be used for any thermomechanical treatment.

Thermomechanical treatment of such articles is often desirable and/or necessary to provide desired characteristics of the final product. Such treatments provide numerous benefits including an increase in strength and toughness, self-tempering due to the temperature gradient across the cross section of the article, improved ductility of the end product, and grain refinement which provides substantial improvements in mechanical properties. Further, controlled and accelerated cooling allows direct quenching of an article following rolling. Such direct quenching yields a desirable phase transformation in the surface portion of the article to upper bainite or martensite, while the remaining portion stays austenitic and is later transformed to ferrite or perlite.

The present invention is directed to the thermomechanical treatment, specifically the cooling, of the aforedescribed workpieces.

The present invention provides controlled and accelerated cooling of the workpiece with recirculated cooling medium and over a reduced period of contact between the cooling medium and the article to be cooled.

Figure 1:
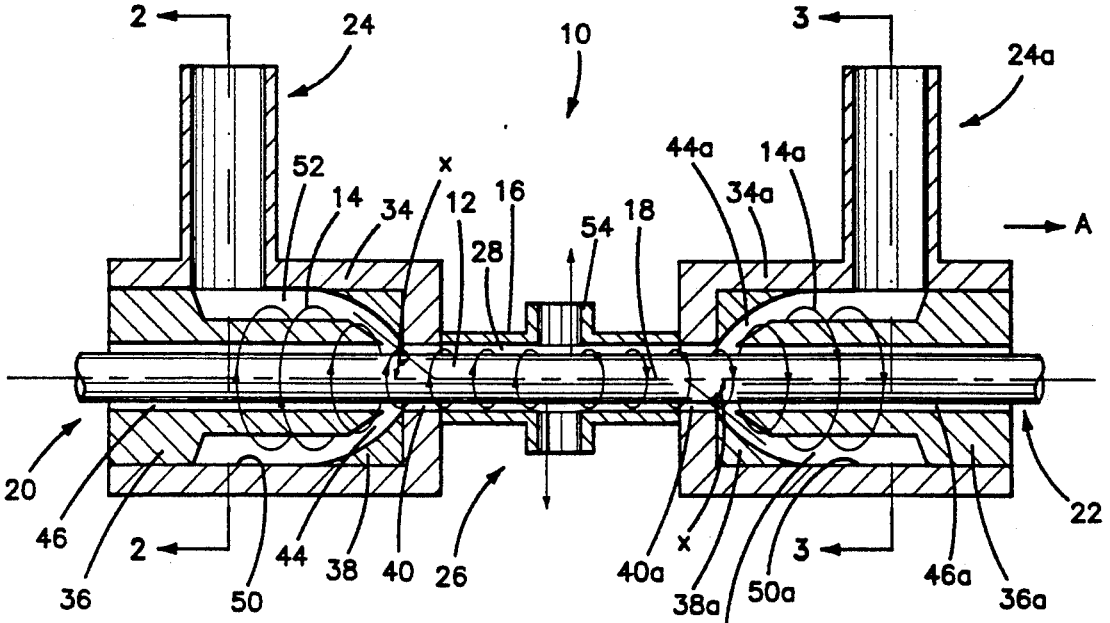
FIG. 1 is a cross section of an apparatus according to the invention.

FIG. 1 shows a preferred embodiment of an apparatus 10 according to the invention. Apparatus 10 is preferably disposed, for example in a rolling mill, as an "in-line" treatment stage for thermomechanically treating workpieces such as continuous non-flat rolled workpiece 12. Apparatus 10 treats workpiece 12 as it advances through apparatus 10, for example in the direction of arrow A. Apparatus 10 serves to provide a helical flow of a cooling medium around workpiece 12 as shown schematically by the helical arrow 14 in FIG. 1.

Such a flow provides accelerated heat extraction from workpiece 12.

Apparatus 10 preferably includes a workpiece cooling passage having a central axis 18, a workpiece inlet 20 and a workpiece outlet 22, as well as cooling medium inlet 24 and cooling medium outlet 26. The workpiece cooling passage comprises a flow area for cooling medium between inlet 24 and outlet 26 wherein cooling medium circulates around workpiece 12 so as to provide accelerated cooling. As shown in FIG. 1, the workpiece cooling passage includes an annular flow space 52 defined between housing 34 and valve body 36 of inlet 24, and annular flow space 28 defined between workpiece 12 on the inside and outlet 40 and pipe 16 on the outside. These elements, particularly valve body 36 and outlet 40, will be further described below.

Cooling medium is introduced into the workpiece cooling passage through inlet 24. Inlet 24 serves to induce a helical flow of the cooling medium around central axis 18 and toward outlet 26. While workpiece 12 is being treated in the workpiece cooling passage, cooling medium preferably flows or circulates helically about workpiece 12 in annular flow spaces 28 and 52 which constitute the workpiece cooling passage. Such a helical flow provides a film of cooling medium around workpiece 12 which provides improved heat extraction from workpiece 12.

The helical flow may preferably be provided by introducing a flow of cooling medium to inlet 24 substantially tangential to an inside surface 50 of housing 34. In other words, the flow is directed into inlet 24 in a direction radially offset from central axis 18. Further, the flow is preferably introduced at an attitude which is non-parallel to central axis 18.

FIG. 1 shows the attitude of introduction of the flow of cooling medium to be substantially perpendicular to central axis 18. It is noted, however, that flow could be introduced at more or less of an angle to central axis 18, and that the angle may be selected to provide a desired linear velocity of the resulting helical flow.

It is further noted that the incoming flow will have a flow area depending upon the size of the inlet for the cooling medium. Portions of this flow area will be more or less tangential with inside surface 50 of housing 34. That is, a portion of the incoming flow may be virtually tangential to inside surface 50, while another portion may actually be oriented directly toward central axis 18. The importance of the tangential flow as related to the present invention is the provision of a rotational flow around central axis 18 which provides the desired helical flow in the workpiece cooling passage. Thus, a substantially tangential flow is one that induces a helical or rotational flow in the workpiece cooling passage.

According to a preferred embodiment of the invention, inlet 24 preferably includes a housing 34 having a valve body 36 disposed therein, a valve seat 38, and an outlet 40. Valve body 36 is preferably slidable in housing 34 relative to valve seat 38. Valve body 36 and valve seat 38 thereby define an adjustable aperture 44 or sliding valve. Valve body 36 also preferably has a passage 46 defined therein for accepting workpiece 12, passage 46 defining workpiece inlet 20.

Figure 2:
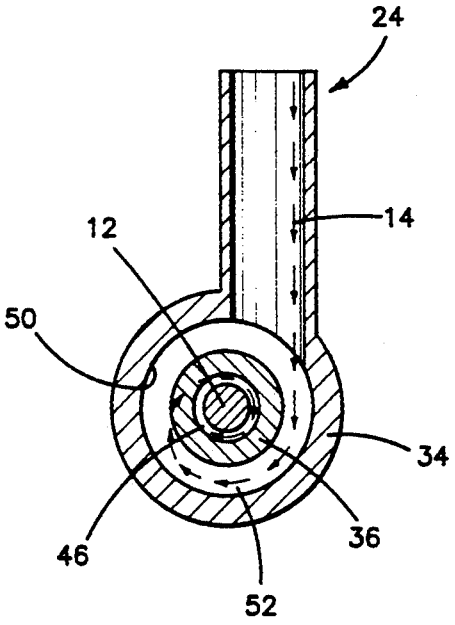
FIG. 2 is a cross section along the lines 2—2 of FIG. 1.

Referring to FIG. 2, a preferred orientation of inlet 24 is illustrated which orientation induces a helical flow of cooling medium, first around valve body 36 as shown in FIG. 1 and thence through outlet 40 and around workpiece 12 in the workpiece cooling passage. As shown, inlet 24 is preferably disposed at an angle to central axis 18 of the workpiece cooling passage. Thus, inlet 24 is arranged so as to introduce a flow of cooling medium substantially tangential to an inside surface 50 of housing 34. As illustrated in FIG. 2, inlet 24 is laterally offset relative to central axis 18, so as to introduce the flow of cooling medium to annular space 52 defined between inside surface 50 and valve body 36. This orientation induces a circulation of cooling medium around valve body 36 which circulation advances toward outlet 40 so as to yield the desired helical flow in the workpiece cooling passage.

Control of pressure and velocity of the cooling medium are useful in obtaining the desired accelerated and controlled cooling. It has been found that the cooling rate of the workpiece is directly proportional to the velocity and pressure of the cooling medium. According to the invention, velocity and pressure can be adjusted by adjusting valve body 36 relative to valve seat 38 so as to modify the size of adjustable aperture 44 (FIG. 1) defined therebetween, thereby modifying the flow velocity and pressure of cooling medium. For typical incoming flow rates of cooling medium, for example, aperture 44 could be adjusted between about 0.5 cm to about 3.0 cm to provide a linear velocity of cooling medium in the workpiece cooling passage of between about 2.0 m/s to about 20 m/s.

The velocity of cooling medium is also preferably controlled so as to provide a relative velocity, in relation to the velocity of the workpiece, of between about 1.5 m/s to about 3.0 m/s.

Valve body 36 and valve seat 38 may preferably be adapted so as to provide the proper "angle of attack" of the cooling medium passing through aperture 44 relative to workpiece 12. The portion of valve body 36 and valve seat 38 which define the "angle of attack" are indicated generally by reference letter x in FIG. 1. Of course the angle could be altered by modifying either or both of the surfaces of valve body 36 and valve seat 38 which define the angle of attack. The "angle of attack" is preferably set between about 25° to about 45° as measured to the central axis 18 with the angle opening away from outlet 26 as shown in FIG. 1.

Still referring to FIG. 1, two helical flows of cooling medium are preferably provided around workpiece 12. Two helical flows could be provided, for example, by providing a second inlet **24*a* as shown in FIG. 1 to induce a second helical flow schematically shown by helical arrow 14*a***. The two helical flows may preferably by directed in opposite linear directions as shown. Further, the two helical flows preferably have opposite directions of rotation. This counter current flow of the cooling medium has been found to provide excellent cooling of the workpiece.

Inlet **24*a* preferably includes the same or similar elements to inlet 24. Thus, inlet 24*a* includes a housing 34*a*, valve body 36*a*, valve seat 38*a*, outlet 40*a*, and passage 46*a*. As shown in FIG. 1, inlet 24*a* is oriented to direct cooling medium opposite to the direction A of movement of workpiece 12, and passage 46*a* of inlet 24*a* therefore serves as workpiece outlet 22**.

Figure 3:
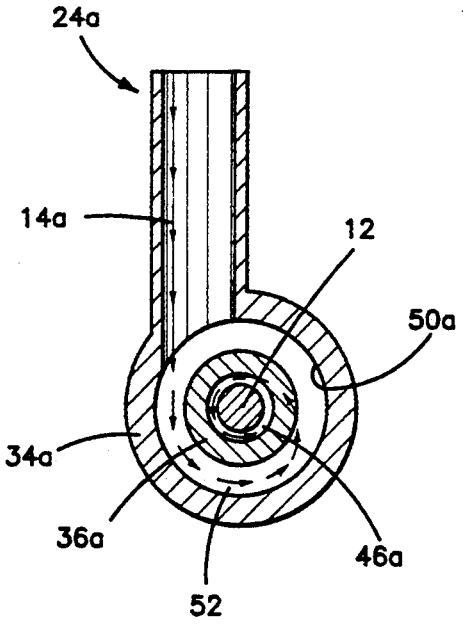
FIG. 3 is a cross section along the lines 3—3 of FIG. 1.

Referring to FIG. 3, inlet **24*a* is oriented substantially perpendicular to and laterally offset in relation to central axis 18 in a similar manner to the orientation of inlet 24. Note, however, that inlet 24*a* is offset relative to central axis 18 in an opposite direction to the offset of inlet 24** so as to induce the desired opposite direction of rotation of the two helical flows.

As shown in FIG. 1, the workpiece cooling passage of the preferred embodiment of the invention is divided into two segments, one defined between inlet 24 and outlet 26, and the other defined between inlet 24a and outlet 26. The helical flow of cooling medium in each segment is preferably counter current and counter rotational to the flow in the other segment as set forth above.

Cooling medium outlet 26 may be adapted to further control the pressure and velocity of the cooling medium. In this regard, outlet 26 may preferably include an expansion chamber which may suitably be defined by an expanded flow area section 54 of outlet 26, as shown. Desirable control of the cooling medium pressure may preferably be obtained by providing an approximate 30% increase in flow area. According to the preferred embodiment of the invention, such an expansion may be accomplished by providing a total outlet flow area of expanded flow area section 54 of approximately 1.3 times the total flow area of cooling medium in the workpiece cooling passage.

Outlet 26 is preferably connected to a flow system (not shown) for reconditioning and recirculating cooling medium back to inlets 24 and 24a. Such a flow system could suitably extract heat from the cooling medium and pump the cooling medium back to inlets 24, 24a in any known or conventional manner.

As shown in FIG. 1, outlet 26 is preferably arranged between two segments of the workpiece cooling passage. Each segment preferably has a length of between about 1000 mm to about 2000 mm. The length of each segment may be provided through any convenient means, including providing pipes 16 having an appropriate length. Further, flow velocity of each helical flow as well as the length of each segment of the workpiece cooling passage are preferably selected so as to balance the two conflicting or counter current flows in the expansion chamber at outlet 26. Balancing the flow at a point of equilibrium at outlet 26 serves to direct the discharge of cooling medium through outlet 26 and also provides further heat extraction from workpiece 12 in the expansion chamber at expanded flow area section 54 of outlet 26.

It should be noted that housing 34, 34a and pipe sections 16 may be of unitary construction or may be interchangeable or modular in structure, as desired, or may have any other convenient and desirable configuration.

By providing two counter current and counter rotational flows of cooling medium along workpiece 12, according to the invention, an accelerated and controlled cooling of workpiece 12 is obtained. Such accelerated and controlled cooling renders the method and apparatus of the present invention ideally suitable to "in-line" procedures.

According to another embodiment of the invention, relief channels may be located between the workpiece cooling passage and the expansion chamber whereby steam and air accumulated in the cooling passage is conveyed to the chamber. Such relief channels may, for example, be positioned at any point along the workpiece cooling passage which is suitable and convenient. In this regard, a portion of the workpiece cooling passage, for example a portion of pipe 16, may have a double wall structure, with the relief channels being located in the annular space between the walls of the double walled structure.

It should be noted that a preferable cooling medium is water but, of course, numerous suitable conventional cooling media could be substituted.

It is to be understood that the invention is not limited to the illustrations described and shown herein, which are deemed to be merely illustrative of the best modes of carrying out the invention, and which are susceptible of modification of form, size, arrangement of parts and details of operation. The invention rater is intended to encompass all such modification which are within its spirit and scope as defined by the claims.

What is claimed is:

1. An apparatus for cooling a workpiece, comprising a workpiece cooling passage having inlet means for receiving the workpiece and outlet means for discharging the workpiece, the cooling passage having a central axis and further including inlet means for introducing a cooling medium and outlet means for removing the cooling medium from the cooling passage, the cooling medium inlet means providing a substantially helical flow of cooling medium in the cooling passage around the central axis from the cooling medium inlet means to the cooling medium outlet means, the cooling medium outlet means including chamber means downstream of the cooling passage for expanding a flow area of the cooling medium, whereby pressure and velocity of the cooling medium in the cooling passage are controlled so as to provide accelerated cooling of the workpiece.

2. An apparatus according to claim 1, wherein the cooling medium inlet means includes a housing having a substantially cylindrical inside surface, a cooling medium inlet, an outlet communicating with the cooling passage, a valve seat and a valve body, the valve body being slidably disposed relative to the valve seat, the cooling medium inlet being arranged in the housing so as to introduce cooling medium substantially tangential to the inside surface of the housing, whereby cooling medium introduced through the cooling medium inlet circulates helically in the housing around the valve body and toward the outlet to the cooling passage.

3. An apparatus according to claim 2, wherein the valve body and the valve seat define an adjustable aperture located between the cooling medium inlet and the outlet.

4. An apparatus according to claim 1, wherein the cooling medium inlet means includes a first cooling medium inlet means and a second cooling medium inlet means, the cooling medium outlet means being disposed between the first and second cooling medium inlet means so as to divide the cooling passage into a first cooling passage segment and a second cooling passage segment, the first cooling medium inlet means being arranged so as to provide a first substantially helical flow of cooling medium in the first cooling passage segment around the central axis toward the cooling medium outlet means, and the second cooling medium inlet means being arranged so as to provide a second substantially helical flow of cooling medium in the second cooling passage segment around the central axis toward the cooling medium outlet means.

5. An apparatus according to claim 4, wherein the first cooling medium inlet means and the second cooling medium inlet means each comprise a housing having a substantially cylindrical inside surface, a cooling medium inlet, an outlet communicating with the cooling passage, a valve seat and a valve body, the valve body being slidably disposed relative to the valve seat, the cooling medium inlet being arranged in the housing so as to introduce cooling medium substantially tangential to the inside surface of the housing, whereby cooling medium introduced through the cooling medium inlet circulates helically in the housing around the valve body and toward the outlet to the cooling passage.

6. An apparatus according to claim 5, wherein the first cooling medium inlet means provides a first helical flow and the second cooling medium inlet means provides a second helical flow, the first and second helical flows having opposite directions of rotation.

7. An apparatus according to claim 4, wherein the valve body and the valve seat of each of the first and second valve means define an adjustable aperture located between respective cooling medium inlets and outlets.

8. An apparatus according to claim 7, wherein the aperture has an angle of attack of between about 25° to about 45°.

9. An apparatus according to claim 4, wherein the cooling medium outlet means is located between the first cooling passage segment and the second cooling passage segment at a point of equilibrium between the first and second helical flows.

10. An apparatus according to claim 4, wherein the first cooling medium inlet means has a first workpiece passage communicating with the cooling passage and serving as the workpiece inlet means, and the second cooling medium inlet means has a second workpiece passage communicating with the cooling passage and serving as the workpiece outlet means.

11. An apparatus according to claim 4, wherein the chamber means has an outlet flow area of about 1.3 times a total flow area of the cooling medium through the cooling passage.

12. An apparatus according to claim 4, wherein each of the first cooling passage segment and the second cooling passage segment has a length of between about 1000 mm to about 2000 mm.

13. An apparatus according to claim 4, further including relief channels located between the cooling passage and the chamber means whereby steam and air accumulated in the cooling passage is conveyed to the chamber means.

14. A method for cooling a workpiece comprising the steps of:

providing the workpiece;

providing a workpiece cooling passage;

advancing the workpiece through the workpiece cooling passage while circulating a substantially helical flow of a cooling medium around the workpiece; and providing chamber means downstream of the cooling passage for expanding a flow area of the cooling medium whereby pressure and velocity of the cooling medium in the cooling passage are controlled so as to provide accelerated cooling of the workpiece.

15. A method according to claim 14, wherein the circulating step further includes the steps of:

providing an inlet means including a housing having a substantially cylindrical inside surface, a cooling medium inlet, an outlet communicating with the cooling passage, a valve seat and a valve body, the valve body being slidably disposed relative to the valve seat; and flowing the cooling medium into the inlet means substantially tangential to the inside surface of the housing, whereby the cooling medium flows substantially helically in the housing around the valve body and toward the outlet to the cooling passage.

16. A method according to claim 14, wherein the circulating step includes circulating two substantially helical flows around the workpiece in substantially opposite linear directions.

17. A method according to claim 16, wherein the step of circulating two flows includes the step of circulating the two flows in substantially opposite directions of rotation.

18. A method according to claim 16, wherein the step of circulating two flows includes the steps of:

providing a first inlet means and a second inlet means, each inlet means including a housing having a substantially cylindrical inside surface, a cooling medium inlet, an outlet communicating with the cooling passage, a valve seat and a valve body, the valve body being slidably disposed relative to the valve seat; and flowing the cooling medium into the first and second inlet means substantially tangential to the inside surface of the valve housing, whereby the cooling medium flows substantially helically in the housing around the valve body and toward the outlet to the cooling passage.

19. A method according to claim 18, wherein the valve body and the valve seat of the first and second inlet means each define an aperture located between a respective cooling medium inlet and outlet, the method further including the step of adjusting the size of each aperture, thereby controlling a velocity of the cooling medium exiting the first and second inlet means.

20. A method according to claim 19, wherein the adjusting step includes adjusting the aperture so as to provide a linear velocity of each of the two substantially helical flows of between about 2.0 m/s to about 20 m/s.

21. A method according to claim 20, further including the step of passing the workpiece through the cooling passage at a workpiece velocity, the adjusting step further including the step of providing the velocity of each of the two substantially helical flows so as to provide a relative velocity of each helical flow, in relation to the workpiece velocity, of between about 1.5 m/s to about 3.0 m/s.

22. A method according to claim 16, wherein the step of circulating two flows includes the steps of:

circulating the two flows toward each other; and providing a cooling medium outlet means having chamber means for expanding a flow area of the cooling medium, the outlet means being provided at a point of equilibrium between the two flows, whereby pressure and velocity of the cooling medium in the cooling passage are controlled.

23. A method according to claim 22, wherein the step of circulating two flows includes circulating each flow toward the outlet means along a linear distance of between about 1000 mm to about 2000 mm.

24. A method according to claim 22, further including the step of recirculating the cooling medium from the chamber means to the first and second inlet means.

25. An apparatus for cooling a workpiece, comprising a workpiece cooling passage having inlet means for receiving the workpiece and outlet means for discharging the workpiece, the cooling passage having a central axis and further including inlet means for introducing a cooling medium and outlet means for removing the cooling medium from the cooling passage, the cooling medium inlet means defines an adjustable aperture providing a substantially helical flow of cooling medium in the cooling passage around the central axis from the cooling medium inlet means to the cooling medium outlet means, the cooling medium outlet means including chamber means downstream of the cooling passage for expanding a flow area of the cooling medium, whereby pressure and velocity of the cooling medium in the cooling passage are controlled so as to provide accelerated cooling of the workpiece.

* * * * *